US007001206B2

(12) United States Patent
Sakurai et al.

(10) Patent No.: US 7,001,206 B2
(45) Date of Patent: Feb. 21, 2006

(54) CONNECTOR AND A CONNECTOR ASSEMBLY

(75) Inventors: Toshikazu Sakurai, Yokkaichi (JP); Yukihiro Fukatsu, Yokkaichi (JP); Satoshi Suda, Wako (JP); Yoshiaki Kida, Wako (JP); Masaru Shinmura, Wako (JP)

(73) Assignees: Sumitomo Wiring Systems, Ltd., (JP); Honda Giken Kogyo Kabushiki Kaisha, (JP)

( * ) Notice: Subject to any disclaimer, the term of this patent is extended or adjusted under 35 U.S.C. 154(b) by 0 days.

(21) Appl. No.: 10/866,420

(22) Filed: Jun. 10, 2004

(65) Prior Publication Data

US 2004/0253884 A1 Dec. 16, 2004

(30) Foreign Application Priority Data

Jun. 11, 2003 (JP) ..... 2003-167010

(51) Int. Cl.
*H01R 3/00* (2006.01)

(52) U.S. Cl. ..... 439/489; 439/752; 439/595

(58) Field of Classification Search ..... 439/489, 439/752, 595

See application file for complete search history.

(56) References Cited

U.S. PATENT DOCUMENTS

| | | | | |
|---|---|---|---|---|
| 5,108,319 | A * | 4/1992 | Tsuji et al. | 439/752 |
| 5,151,452 | A * | 9/1992 | Fennhoff et al. | 521/48 |
| 5,292,262 | A * | 3/1994 | Endo et al. | 439/752 |
| 5,378,176 | A * | 1/1995 | Sasai | 439/752 |
| 5,865,653 | A * | 2/1999 | Okada et al. | 439/752 |
| 5,897,402 | A * | 4/1999 | Sasai et al. | 439/752 |
| 5,934,946 | A * | 8/1999 | Nakamura | 439/752 |
| 6,328,613 | B1 * | 12/2001 | Kashiyama | 439/752 |
| 6,558,206 | B1 * | 5/2003 | Machida et al. | 439/752 |

* cited by examiner

*Primary Examiner*—Truc Nguyen
(74) *Attorney, Agent, or Firm*—Gerald E. Hespos; Anthony J. Casella

(57) ABSTRACT

A male housing (70) has a receptacle (71) for receiving a female housing (20). An introducing surface (77) is formed around the inner front edge of the receptacle (71). A retainer (40) for locking female terminal fittings has an interfering portion (49) that interferes with the receptacle (71) when the retainer (40) is at an incomplete mount position IMP. The interfering portion (49) has a guiding surface (50) for guiding the interfering portion (49) into the receptacle (71) when the retainer (40) is a full locking position. The interfering portion (49) has contact surfaces (57) and the inner front edge of the receptacle (71) has receiving surfaces (79) at positions corresponding to the contact surfaces (57) and backward from the introducing surface (77). The receiving surfaces (79) can achieve surface contact with the contact surfaces (57).

16 Claims, 18 Drawing Sheets

CONNECTOR AND A CONNECTOR ASSEMBLY

BACKGROUND OF THE INVENTION

1. Field of the Invention

The invention relates to a connector with a retainer and to a connector assembly.

2. Description of the Related Art

U.S. Pat. No. 5,865,653 discloses a connector with male and female housings. The male housing has a receptacle and the female housing is fittable in the receptacle. A retainer is mounted into the female housing for locking female terminal fittings in the female housing. The retainer is movable between a partial locking position where the female terminal fittings can be inserted and withdrawn and a full locking position where the female terminal fittings are locked by the retainer. An outer end of the retainer projects from the female housing if the retainer is at an incomplete mount position. This projecting portion contacts the leading end of the receptacle to prevent a connecting operation. Thus, an incomplete mounting of the retainer can be detected.

A slanted introducing surface is formed at the inner peripheral edge of the leading end of the receptacle to facilitate introduction of the female housing. Similarly, the front edge of the outer end of the retainer has an arcuate guiding surface for guiding the retainer into the receptacle when the retainer is at the full locking position. However, the introducing surface and the guiding surface can permit an incompletely mounted retainer to be introduced into the receptacle. As a result, there is a possibility of overlooking the state where the retainer is mounted incompletely.

The present invention was developed in view of the above problem and an object thereof is to securely detect the incomplete mounting of a retainer.

SUMMARY OF THE INVENTION

The invention relates to a connector that has a housing and a mating housing with a receptacle for receiving the housing. A retainer is mountable on the housing for locking at least one terminal fitting in the housing. The retainer has at least one fastening section for locking the terminal fitting when the retainer is at a complete mount position in the housing. The retainer also has at least one interfering portion that can interfere with the receptacle when the retainer is at an incomplete mount position. The interfering portion has at least one guiding surface for guiding the entry of the interfering portion into the receptacle when the retainer is at the complete mount position. The interfering portion has at least one contact surface in place of a part of the guiding surface. The contact surface can be brought into surface contact with at least one receiving surface at a position on the inner peripheral edge of the leading end of the receptacle.

The introducing surface guides the housing into the receptacle when the retainer is at the complete mount position and the guiding surface permits smooth entry of the interfering portion into the receptacle. On the other hand, the interfering portion interferes with the receptacle if a connecting operation is attempted with the retainer at the incomplete mount position on the housing. At this time, the contact surface of the interfering portion comes into surface contact with the receiving surface of the receptacle to create a large resistance force. Thus, the connecting operation is prevented, and the incomplete mounting of the retainer is detected.

The receiving surface is formed in place of a part of the introducing surface at a position of the inner peripheral edge of the leading end of the receptacle substantially corresponding to the contact surface. The receiving surface preferably is more backward than the introducing surface.

At least one push-in preventing projection preferably is provided on the housing and engages the retainer to prevent the retainer from being pushed inadvertently to the complete mount position unless an operation force of a specified intensity or higher is exerted.

The housing preferably comprises a retainer mount hole into which the retainer is insertable. The retainer mount hole open towards one side wall and two adjacent side walls of the housing.

At least one clearance preferably is defined between the retainer and the retainer mount hole of the housing when the retainer is at the incomplete mount position. The inserted states of the female terminal fittings can be confirmed through the clearance from outside the housing.

The retainer preferably has a retainer main body and two side plates at substantially opposite widthwise ends of the retainer main body. The side plates preferably are substantially flush with the outer side surfaces of the housing when the retainer is at the complete mount position.

The receiving surface is more backward than the introducing surface. Thus, a good connecting operability is ensured without impairing a guiding function by the introducing surface in the case that the retainer is located at the complete mount position.

The receiving surface preferably is wider than the contact surface. The connecting surface of the housing may be inclined to the mating housing with respect to the widthwise direction during a connecting operation. Thus, the contact surface may be shifted from the receiving surface with respect to the widthwise direction. However, the receiving surface preferably is wider than the contact surface, and thus the contact surface securely contacts the receiving surface. As a result, the incomplete mounting of the retainer can be detected more securely.

The receiving surface preferably is inclined slightly at an obtuse angle to the connecting direction of the housings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
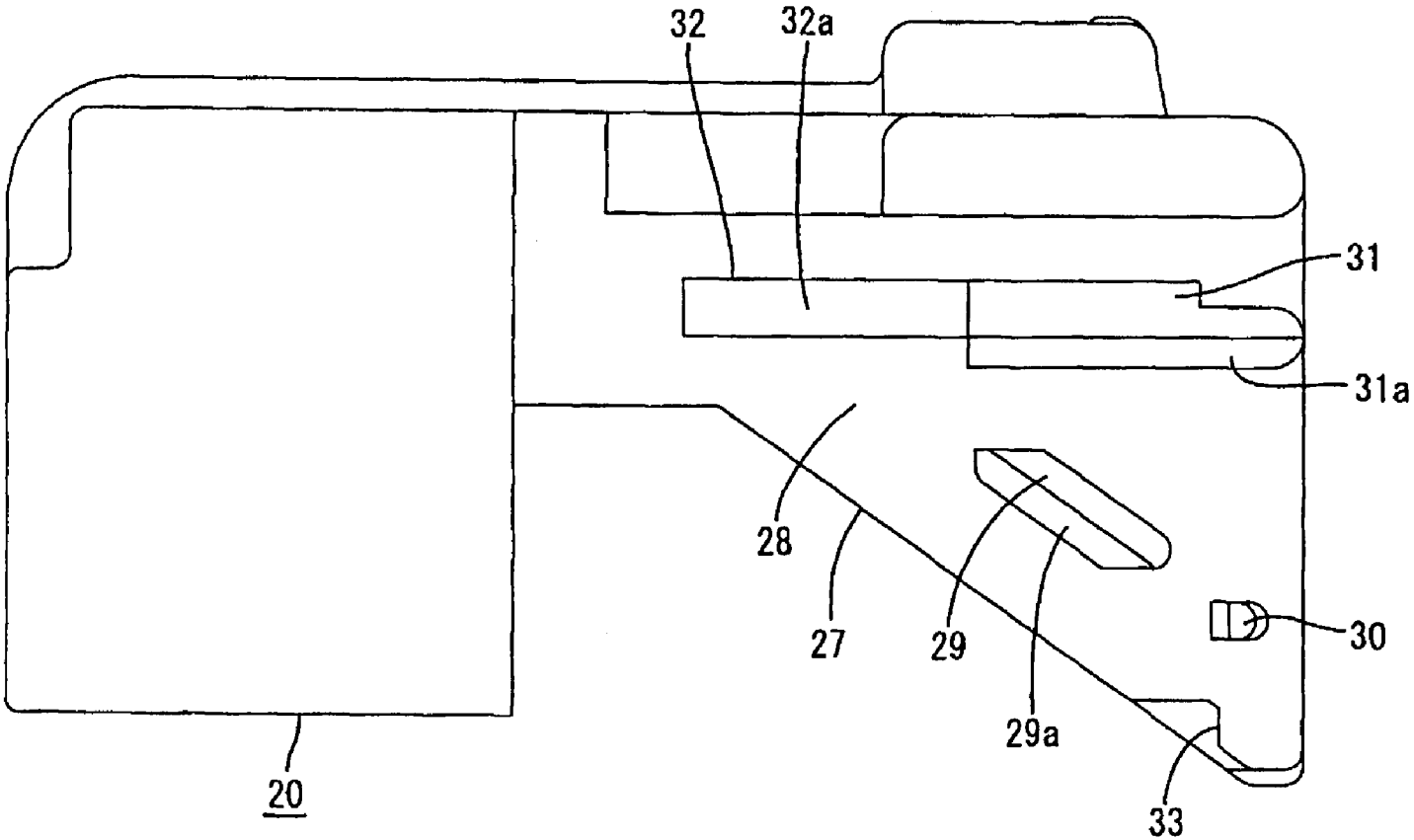
FIG. 1 is a side view of a female housing according to one embodiment of the invention.

A connector according to the invention is illustrated in FIGS. 1 to 18 and includes a female housing 20 and a male housing 70 that are connectable with each other. Female and male terminal fittings 10, 60 are accommodated in the female and male housings 20, 70, respectively, and can be locked by retainers 40, 75 so as not to come out. In the following description, sides of the housings 20, 70 that are to be connected are referred to as the front side and reference is made to all the figures except FIG. 3 concerning the vertical direction.

Figure 10:
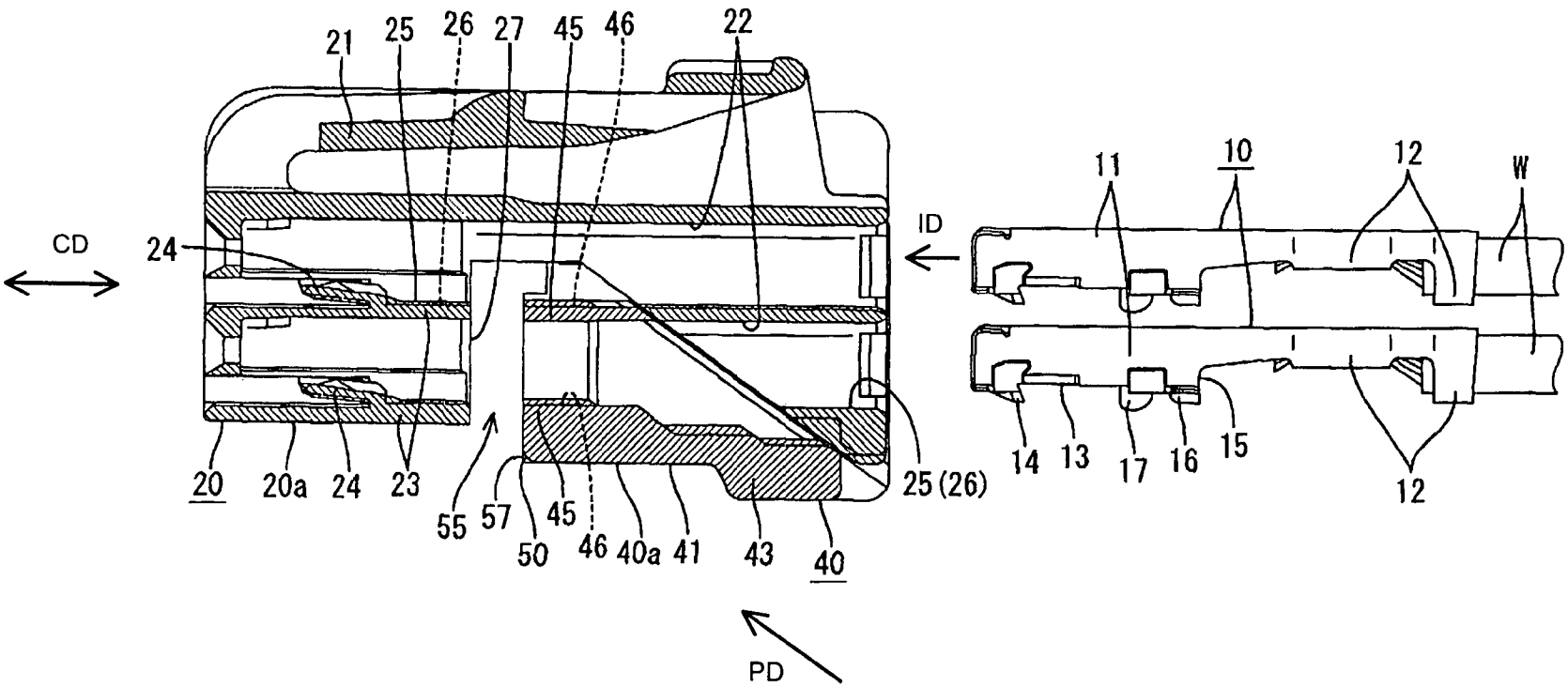
FIG. 10 is a side view in section showing female terminal fittings and the female housing having the retainer mounted at a partial locking position.
Figure 11:
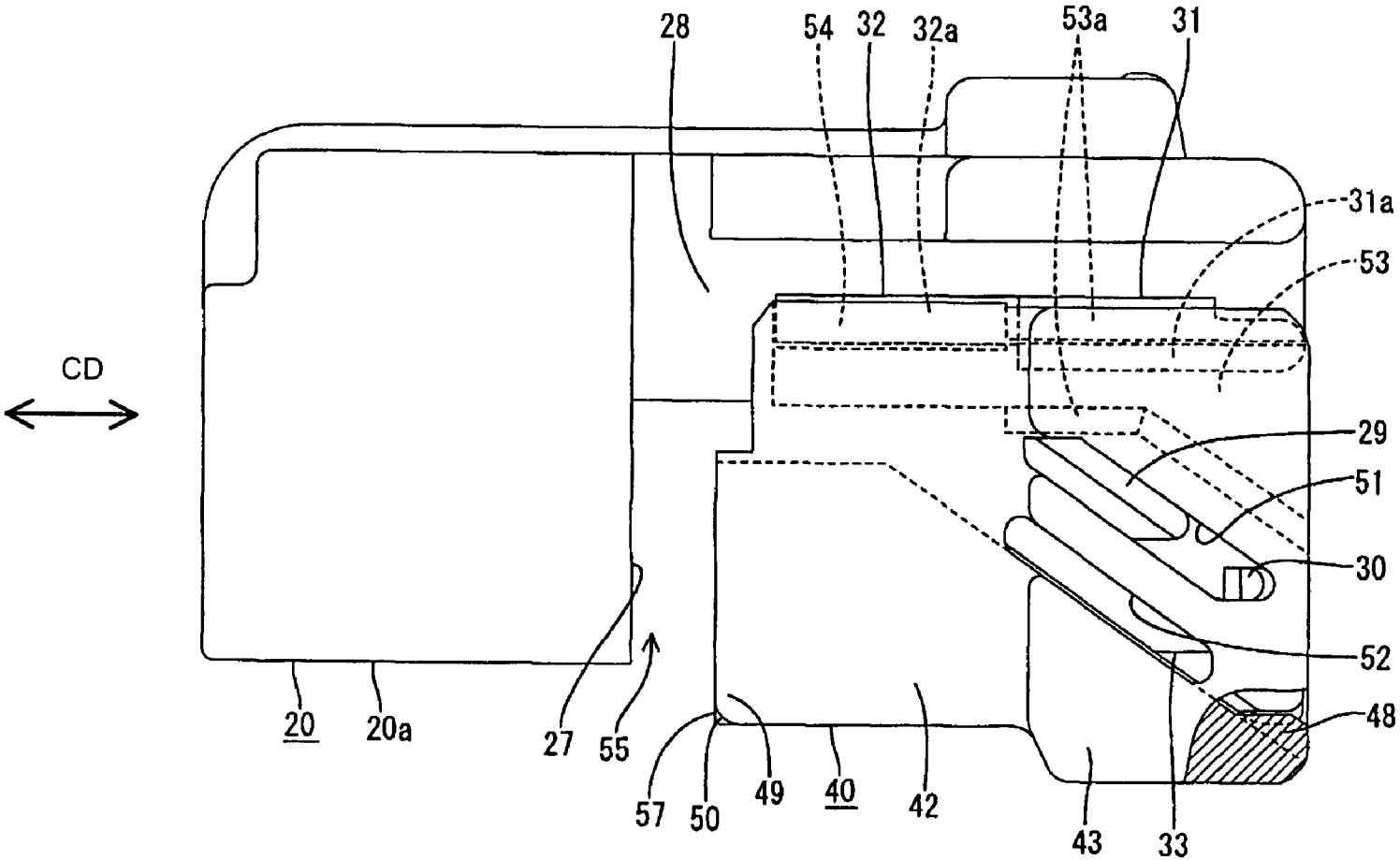
FIG. 11 is a side view partly in section of the female housing having the retainer mounted at the partial locking position.

Each female terminal fitting 10 is formed by, e.g. bending, folding and/or embossing a conductive (preferably metallic) plate stamped or cut out to have a specified development. More particularly, each female terminal fitting 10 includes a main portion 11 and a barrel 12 that are coupled one after the other. The main portion 11 is a substantially rectangular tube that is electrically connectable with a mating male terminal fitting. The barrel 12 has substantially opposed front crimping pieces that are to be crimped, bent or folded into connection with a core of the wire W, as shown in FIG. 10. The barrel 12 also has substantially opposed rear crimping pieces that are to be crimped, bent or folded into an insulation coating of the wire W.

A recess 13 is formed at a substantially longitudinal middle of the bottom surface of the main portion 11, and a locking projection 14 is embossed or cut and bent to project out at the front edge of the recess 13. A locking step 15 is formed at the rear end of the bottom surface of the main portion 11 for engagement by the retainer 40. The locking step 15 projects up and out to substantially the same projecting distance as the locking projection 14 and has an embossed protrusion 16 that is engageable with the retainer 40. A stabilizer 17 projects out beyond the protrusion 16 at a position immediately before the protrusion 16. The stabilizer 17 stabilizes insertion of the female terminal fitting 10 and prevents improper or upside-down insertion.

Figure 2:
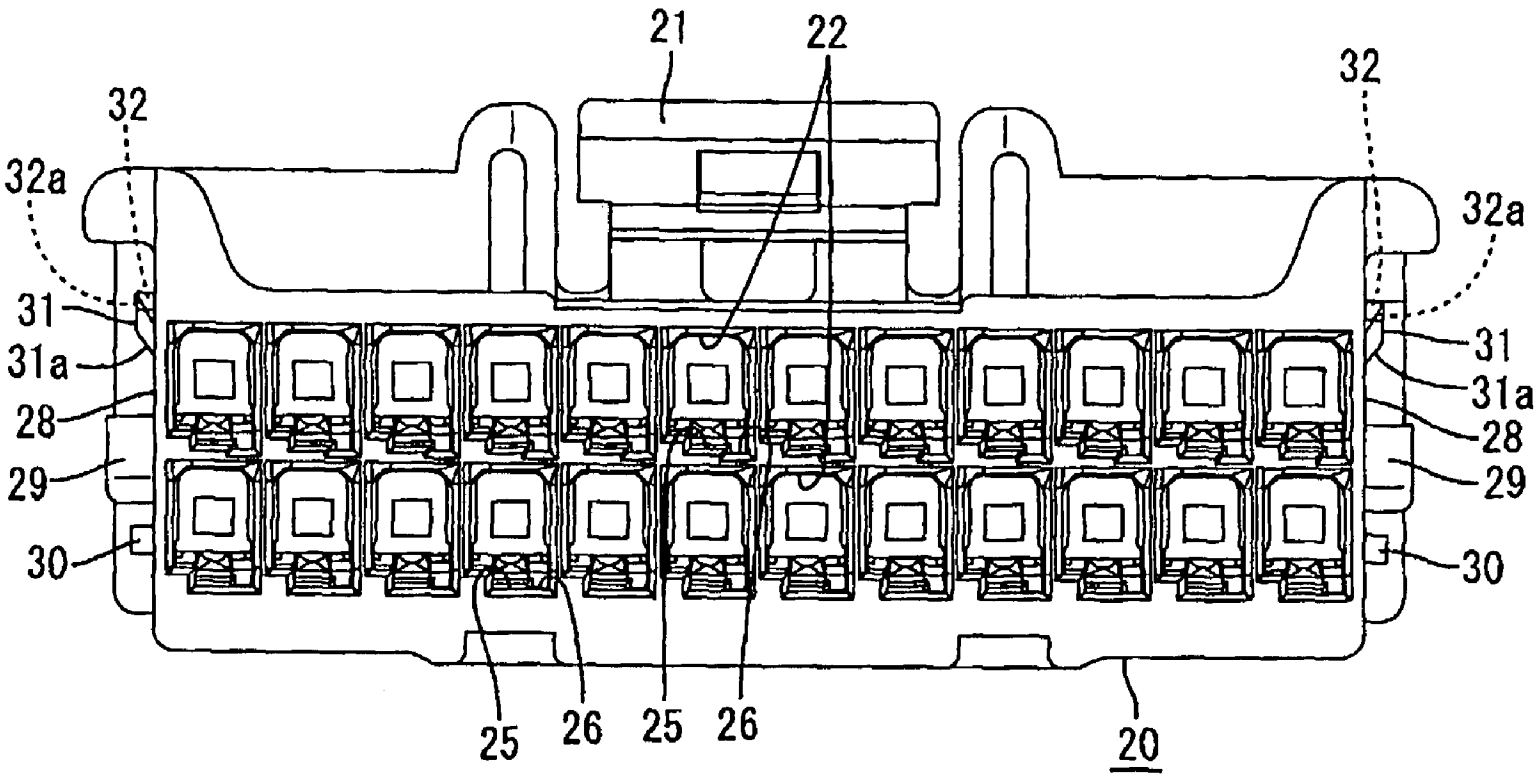
FIG. 2 is a rear view of the female housing.
Figure 3:
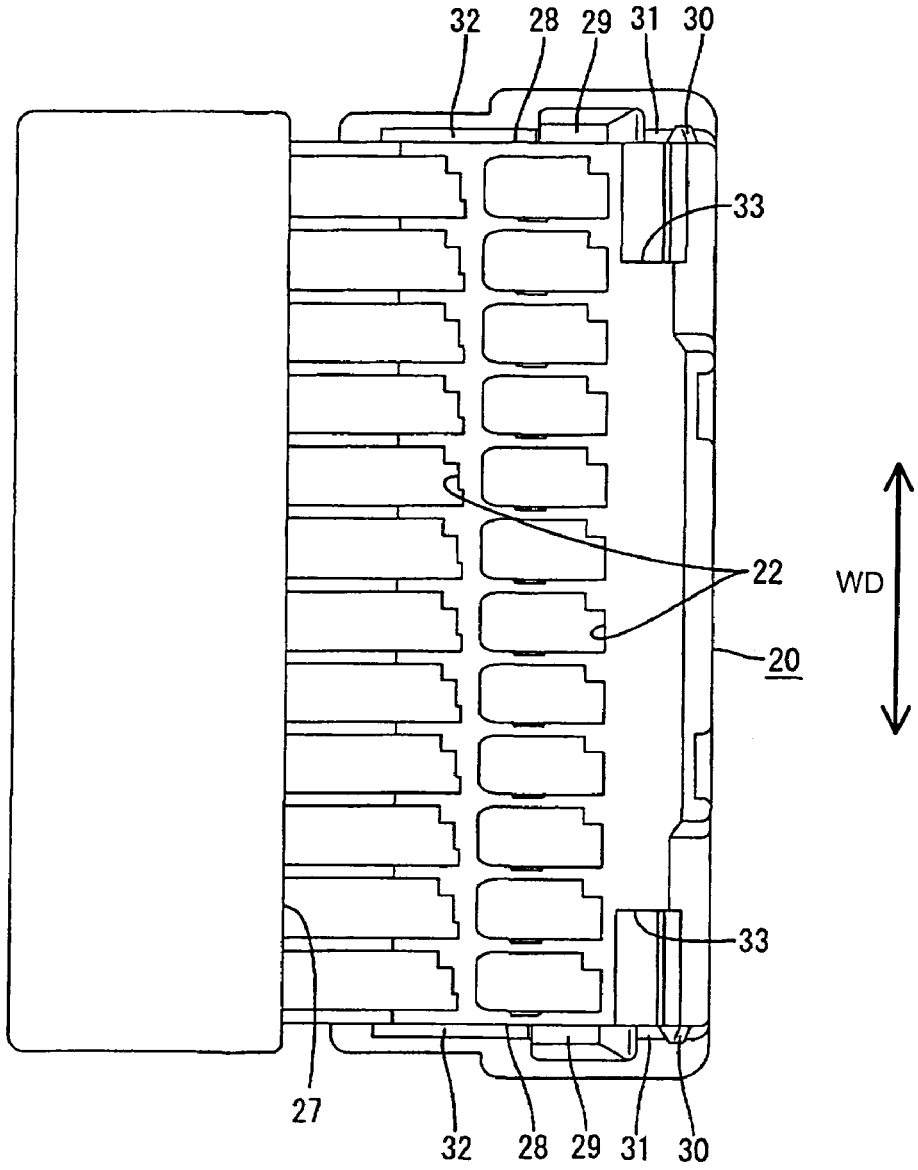
FIG. 3 is a bottom view of the female housing.

The female housing 20 is made e.g. of a synthetic resin and is substantially in the form of a block. A resiliently deformable lock arm 21 is formed on the female housing 20, as shown in FIGS. 2 and 10. The female housing 20 also has cavities 22 and the female terminal fittings 10 can be inserted into the cavities 22 from behind along an inserting direction ID. The cavities 22 penetrate the female housing 20 along forward and backward directions, and are arranged along a widthwise direction WD at upper and lower stages.

A lock 24 is cantilevered forward along the inserting direction ID at a front part of a bottom wall 23 of each cavity 22 and is engageable with the female terminal fitting 10. The lock 24 is resiliently deformable inwardly and outwardly in directions intersecting the inserting and withdrawing directions ID of the female terminal fitting 10. The bottom wall 23 of the cavity 22 is recessed substantially in the widthwise middle over substantially the entire length to form a protrusion insertion groove 25 into which the locking projection 14 and the protrusion 16 are insertable. The protrusion insertion groove 25 is formed over substantially the entire length of the lock 24 to reduce a degree of deformation of the lock 24 during insertion of the female terminal fitting 10. The bottom wall of the cavity 22 also is recessed at its right edge of FIG. 2 to form a stabilizer insertion groove 26 into which the stabilizer 17 is insertable. The stabilizer insertion groove 26 reaches a position slightly behind a base end of the lock 24 and is open only backward. The protrusion insertion grooves 25 are deeper than the stabilizer insertion grooves 26 at one stage (e.g. the upper stage), whereas the protrusion insertion grooves 25 and the stabilizer insertion grooves 26 have substantially the same depth at another stage (e.g. the lower stage).

The retainer 40 is mountable in a retainer mount hole 27 formed in a surface of the female housing 20 substantially opposite the surface where the lock arm 21 is provided. The retainer mount hole 27 is formed in the bottom surface of the female housing 20 substantially facing in a pushing direction PD of the retainer 40 and in the opposite side surfaces of the female housing 20 extending substantially along the pushing direction PD of the retainer 40. Accordingly, the retainer mount hole 27 is open at three sides. The retainer mount hole 27 at least partly exposes all of the cavities 22 to the outside and has a depth to cut off about halves of side walls that partition the cavities 22 along the widthwise direction WD. Thus, the inserted female terminal fittings 10 are not exposed completely sideways to the outside. The bottom walls 23 of the cavities 22 at the upper stage and the opposite side walls and the bottom walls 23 of the cavities 22 at the lower stage are divided into front and rear sections by the retainer mount hole 27. The front edge of the retainer mount hole 27 is substantially straight along a direction substantially normal to the inserting direction ID, whereas the rear edge thereof is inclined down and to the back. An angle of inclination substantially corresponding to the pushing direction PD is smaller than about 45° and preferably about 35° with respect to the inserting direction ID of the female terminal fittings 10. The retainer 40 being mounted can be pushed in the pushing direction PD substantially along the inclination of the rear edge of the retainer mount hole 27.

Figure 7:
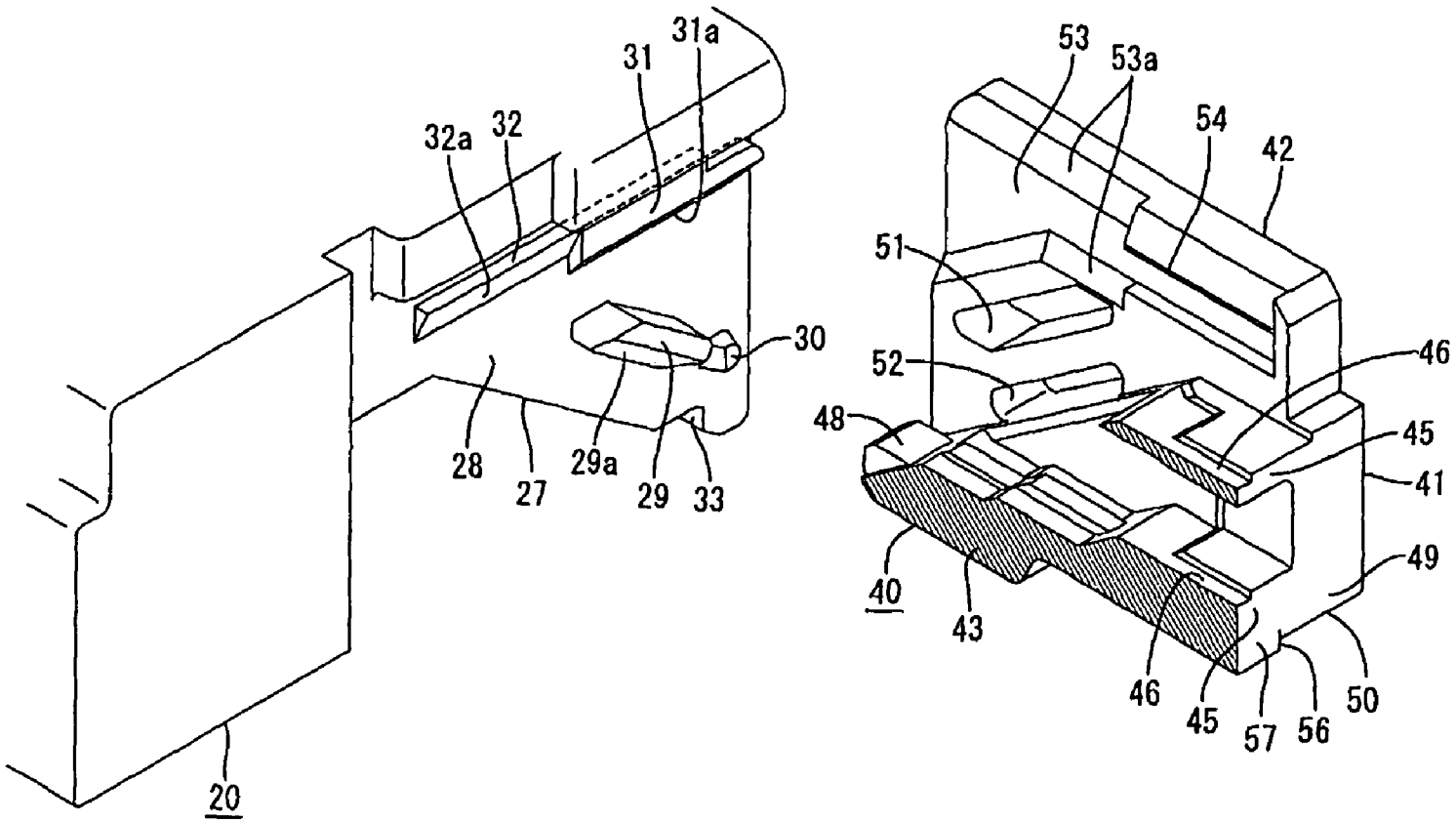
FIG. 7 is a perspective view showing a locking projection, a guide groove and portions around them.

Areas of the opposite side surfaces of the female housing 20 above and behind side openings of the retainer mount hole 27 are recessed slightly from front areas to form stepped surfaces 28, as shown in FIGS. 1 and 7. A substantially rib-shaped locking projection 29 is provided on each stepped surface 28 and extends substantially along the inclination of a slanted side of the side opening of the retainer mount hole 27 and hence substantially parallel to the pushing direction PD. A main function of the locking projections 29 is to stabilize the posture of the retainer 40 being pushed in the pushing direction PD into the female housing 20. Chamfering 29*a* extends substantially entirely along the lower side of an outer surface of each locking projection 29 with respect to a longitudinal center line. Thus, each locking projection 29 can be fit smoothly into a corresponding guide groove 51 of the retainer 40. The upper and lower end surfaces of the locking projections 29 are substantially horizontal and substantially parallel to the inserting direction ID, and vertical surfaces continuous with the horizontal surfaces are formed at the upper end surfaces of the locking projections 29.

A push-in preventing projection 30 is formed on an extension of the bottom end of each locking projection 29 and is spaced from the locking projection 29 by a specified distance. The push-in preventing projections 30 engage the bottom ends of the guiding grooves 51 of the retainer 40 when the retainer 40 is at a partial locking position (see FIGS. 10 to 12) to prevent the retainer 40 from being pushed inadvertently in the pushing direction PD to a full locking position unless an operation force of a specified intensity or higher is exerted. The push-in preventing projections 30 engage the rear edge of the retainer 40 when the retainer 40 is moved to the full locking position.

Figure 13:
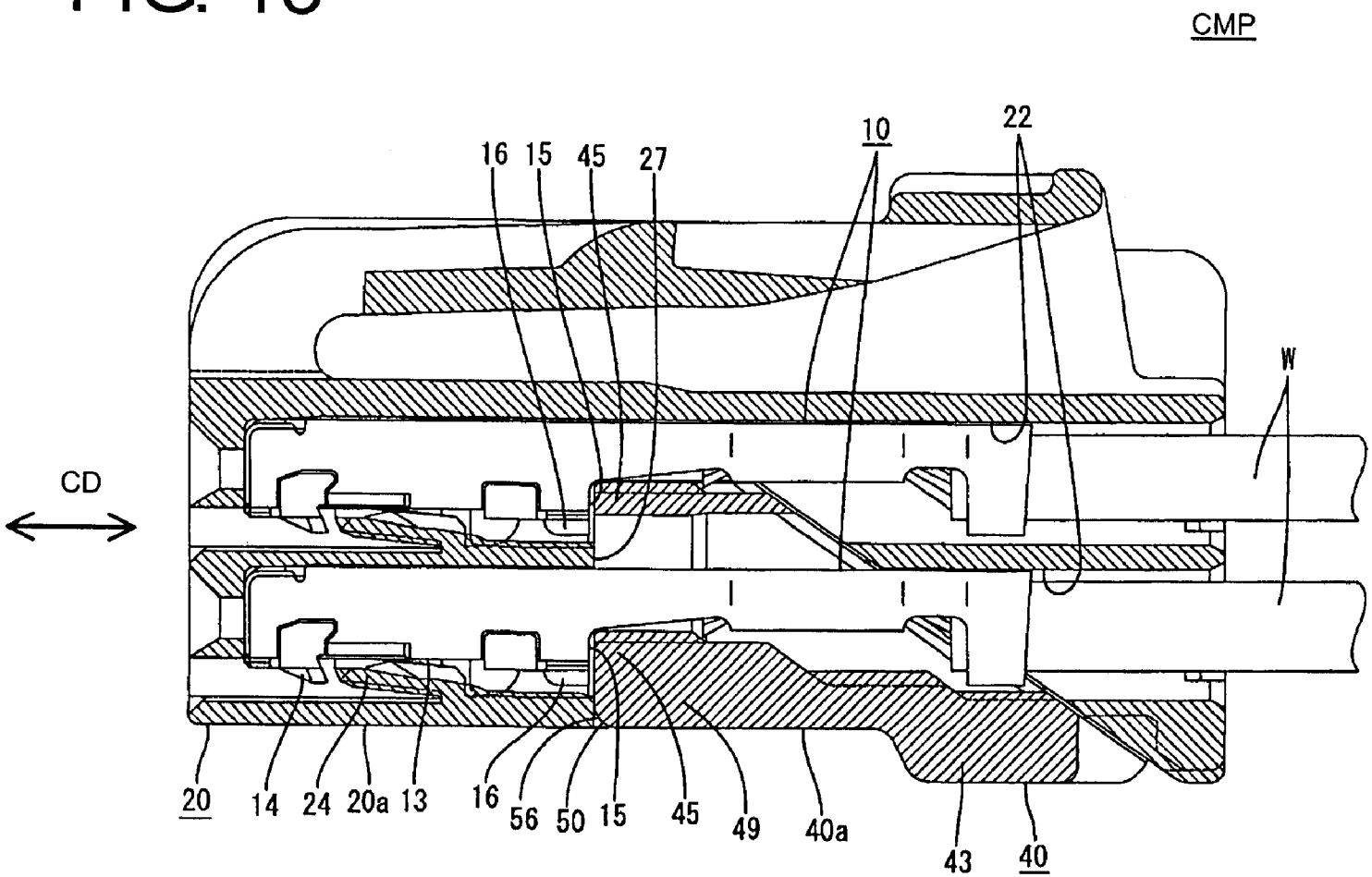
FIG. 13 is a side view in section showing a state where the retainer is located at a full locking position.
Figure 14:
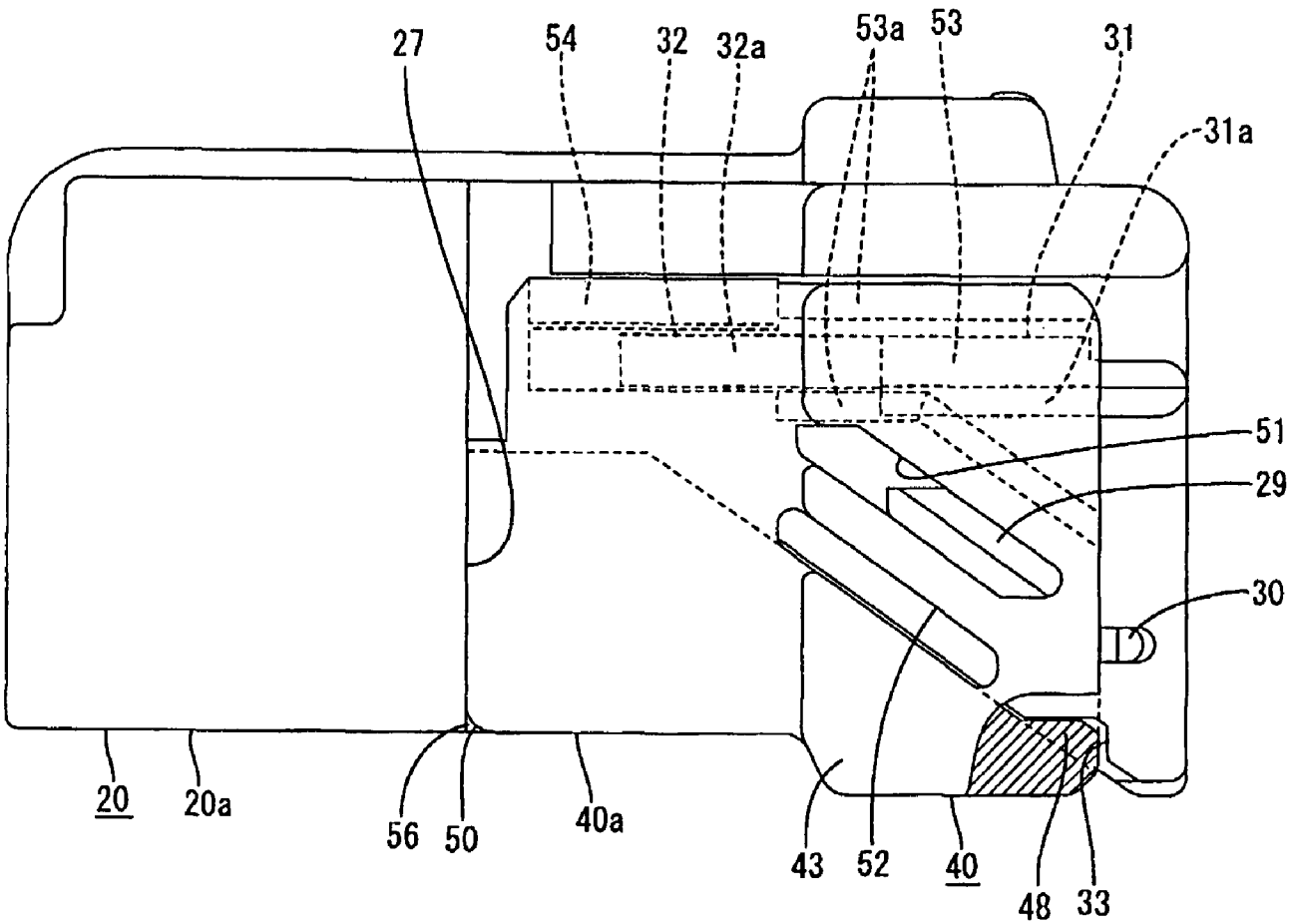
FIG. 14 is a side view partly in section showing a state where the retainer is located at the full locking position.

A shake preventing projection 31 projects above the locking projection 29 on each stepped surface 28 for preventing shake of the retainer 40 at the full locking position FIGS. 13 and 14. The shake preventing projections 31 extend substantially horizontally forward and back along the inserting direction ID. Slanted surfaces 31*a* slope up towards the outer side over substantially the entire length of the lower surfaces of the shake preventing projections 31. Further, a catching piece 32 projects before each shake preventing portion 31. Upper edges of the catching pieces 32 are substantially continuous with upper edges of the respective shake preventing projections 31 and are engageable with locking claws 54 of the retainer 40 to hold the retainer 40 at the full locking position. Slanted surfaces 32*a* slope up towards the outer side of the lower surfaces of the catching pieces 32 so that the locking claws 54 can move smoothly onto the catching pieces 32. Lock recesses 33 are formed at the bottom ends of the opposite widthwise ends of the rear edge of the retainer mount hole 27 with which corresponding locks 48 of the retainer 40 can be engaged to hold the retainer 40 and to prevent the retainer 40 from being displaced back substantially opposite to the pushing direction PD from the full locking position. The rear surfaces of the locking recesses 33 with which the locks 48 are engageable are substantially straight and aligned vertically at an angle to the pushing direction PD.

Figure 4:
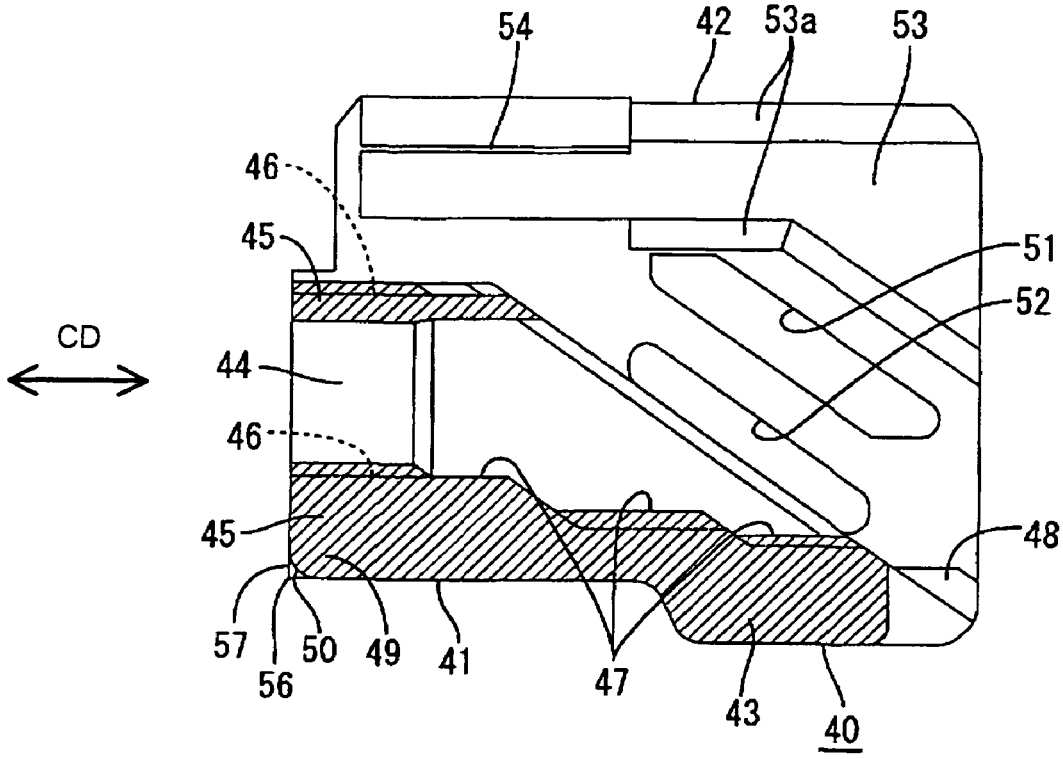
FIG. 4 is a side view in section of a retainer.
Figure 5:
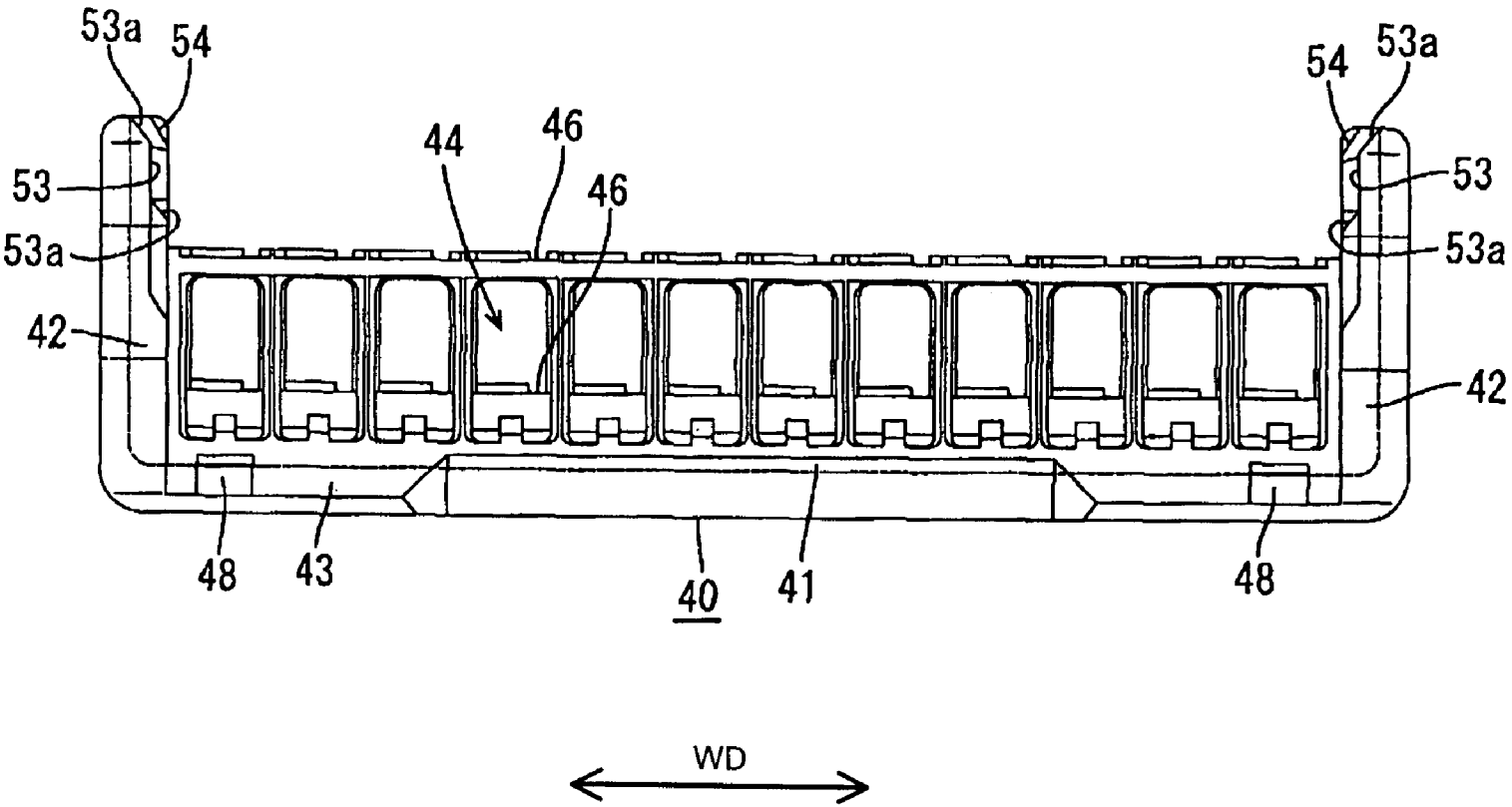
FIG. 5 is a rear view of the retainer.
Figure 6:
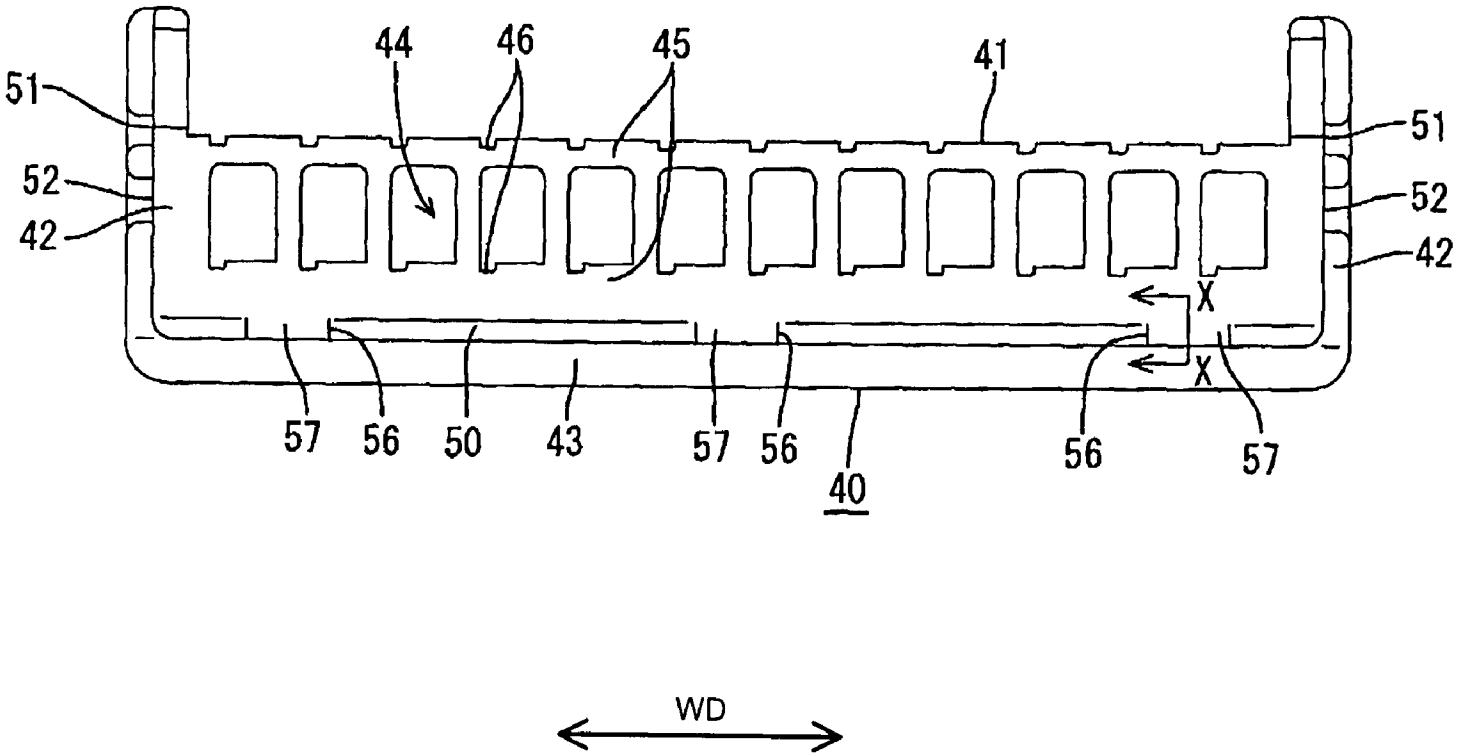
FIG. 6 is a front view of the retainer.

The retainer 40 is made e.g. of a synthetic resin similar to the female housing 20. The retainer 40 includes a retainer main body 41 that is fittable into the retainer mount hole 27 and a pair of side plates 42 that bulge out at opposite widthwise ends of the retainer main body 41, as shown in FIGS. 4 to 6. This retainer 40 is movable along a pushing direction PD oblique to the inserting and withdrawing directions ID of the female terminal fittings 10 between the partial locking position (FIGS. 10–12) and the full locking position (FIGS. 13 and 14) to be described later. A thick operable portion 43 is formed at a substantially entire rear part of the retainer 40.

The retainer main body 41 is formed with the same number of windows 44 as the cavities 22 at each stage of the female housing 20. The windows 44 align with the cavities 22 at the stage on the side where the retainer mount hole 27 is provided (e.g. the lower stage). The front opening edges of the windows 44 extend substantially straight along the vertical direction to conform to the front opening edge of the retainer mount hole 27. However, the rear opening edges are inclined to conform to the inclination of the rear opening edge of the retainer mount hole 27. Front halves of lower portions of the windows 44 and an upper portion of the retainer main body 41 define fastening sections 45 that are aligned with or retracted from the bottom walls 23 of the cavities 22 to permit insertion and withdrawal of the female terminal fittings 10 when the retainer 40 is at the partial locking position (see FIG. 10). However, the fastening sections are in the cavities 22 and engage the locking steps 15 and the protrusions 16 of the female terminal fittings 10 when the retainer 40 is at the full locking position (see FIG. 13). The full locking position corresponds to a complete mount position CMP. Each fastening section 45 has a stabilizer passing groove 46 that communicates with the stabilizer insertion groove 26 of the corresponding cavity 22 when the retainer 40 is at the partial locking position. An escaping recess 47 for escaping projecting parts of the female terminal fitting 10 (barrel 12, etc.) and/or the wire W is formed at a rear side of the fastening section 45. Further, two locks 48 project up and in at the bottom ends of the rear surfaces of windows at the opposite widthwise ends of the retainer 40. The locks 48 have a substantially triangular cross section and engage the corresponding lock recesses 34 when the retainer 40 reaches the full locking position.

A bottom surface 40*a* of a front part of the retainer 40 is substantially flush with a bottom surface 20*a* of the female housing 20 when the retainer 40 is at the full locking position. Accordingly, the bottom end of the front part of the retainer 40 projects down and out from the lower surface 20*a* of the female housing 20 (see FIG. 17) if the retainer 40 is at an incomplete mount position IMP before reaching the complete mount position CMP. This bottom end of the front part of the retainer 40 serves as an interfering portion 49 that can interfere with the male housing 70 when an attempt is made to connect the two housings 20, 70 while the retainer 40 is at the incomplete mount position IMP. A curved or slanted guiding surface 50 is formed over substantially the entire width of the front-bottom edge of the interfering portion 49 except a part thereof. Thus, the interfering portion 49 can be guided to enter the male housing 70 smoothly without getting caught by the inner surface of the male housing 70 if the retainer 40 is at the complete mount position CMP.

The two side plates 42 are spaced to hold the opposite side surfaces of the female housing 20 from the opposite outer sides and are resiliently deformable away from these side surfaces. The side plates 42 are dimensioned to close the side openings of the retainer mount hole 27 and face the corresponding stepped surface 28 when the retainer 40 reaches the full locking position. Further, the side plates 42 have a thickness substantially equal to a level difference between the stepped surfaces 28 and the outer side surfaces of the female housing 20. The side surfaces 42 are substantially flush with the outer side surfaces of the female housing 20 when the retainer 40 is at the full locking position. Thus, the side plates 42 of the retainer 40 serve as the outer walls of side portions of the female housing 20.

The guiding groove 51 penetrates each side plate 42 of the retainer main body 41 at a rear-side position and has an inclination substantially along the rear edges of the respective windows 44 of the retainer 40, i.e. substantially the substantially same inclination as the rear edge of the retainer mount hole 27 (moving direction PD of the retainer 40). The guiding grooves 51 have substantially the same width as the locking projections 29 along shorter sides, and the opposite ends thereof substantially conform to the shapes of the opposite ends of the locking projections 29. Further, the locking projections 29 and the push-in preventing projections 30 can engage the opposite front and rear ends of the guiding grooves 51 to hold the retainer 40 at the partial locking position (see FIG. 11). The side plates 42 move onto the push-in preventing projections 30 to exit the push-in preventing projections 30 from the guiding grooves 51 as the retainer 40 is moved in the pushing direction PD from the partial locking position to the full locking position. The side plates 42 are deformed away from each other during this movement. The height of the locking projections 29 is such that the locking projections 29 project more than the push-in preventing projections 30 and engage the guiding grooves 51 even if the side plates 42 undergo the above deformation. Consequently, the retainer 40 reaches the full locking position (see FIG. 14) by movement of the locking projections 29 towards the bottom ends of the guiding grooves 51. Bored portions 52 having substantially the same inclination as the guiding grooves 53 penetrate the side plates 42 below the guiding grooves 53. The bored portions 52 are narrower than the guiding grooves 53, thereby suitably reducing the rigidity or the cross-section of the side plates 42 to make the side plates 42 easier to be deformed resiliently away from each other.

A preventing recess 53 is formed in the inner surface of each side plate 42 above the guiding groove 51 for receiving the corresponding shake preventing projection 31, and slanted surfaces 53*a* are formed at the upper and bottom ends of the preventing recess 53. The preventing recess 53 extends from a substantially middle of the side plate 42 to the rear end thereof with respect to the length direction and has an open rear end (see FIG. 4). The preventing recess 53 also has an open upper end, and the bottom edge thereof substantially conforms to the shape of the upper edge of the guiding groove 51. Specifically, a front part of the bottom edge is substantially horizontal in forward and backward directions, and hence is substantially parallel to the inserting direction ID. A rear part of the bottom edge slopes down to the back substantially parallel to the pushing direction PD and hence is inclined with respect to the inserting direction ID. Upper edges of the shake preventing projections 31 are held at substantially the same height as the upper edges of the preventing recesses 53 when the retainer 40 is at the partial locking position to define clearances to the bottom edges of the preventing recesses 53 (see FIG. 11). The slanted surfaces 31*a* at the bottom edges of the shake preventing portions 31 and the slanted surfaces 53*a* at the bottom edges of the preventing recesses 53 substantially abut when the retainer 40 is at the full locking position to prevent the retainer 40 from making upward shaking movements and movements along the pushing direction PD (see FIG. 14).

Each preventing recess 53 extends forward, and this extended side is widened. The locking claw 54 is formed at the upper edge of each shake preventing recess 53. The locking claws 54 face the catching pieces 32 of the female housing 20 substantially at the same height when the retainer 40 is at the partial locking position. The locking claws 54 move over the slanted surfaces 32*a* of the catching pieces 32 to engage the upper edges of the catching pieces 32 when the retainer 40 is moved in the pushing direction PD to the full locking position. As a result, the retainer 40 can be held at the full locking position.

A clearance 55 is defined between the front edge of the retainer 40 and the front edge of the retainer mount hole 27 when the retainer 40 is at the partial locking position. Thus, the inserted states of the female terminal fittings 10 (e.g. whether the male terminal fittings 10 are inserted) can be confirmed through the clearance 55 from outside the female housing 20.

Figure 15:
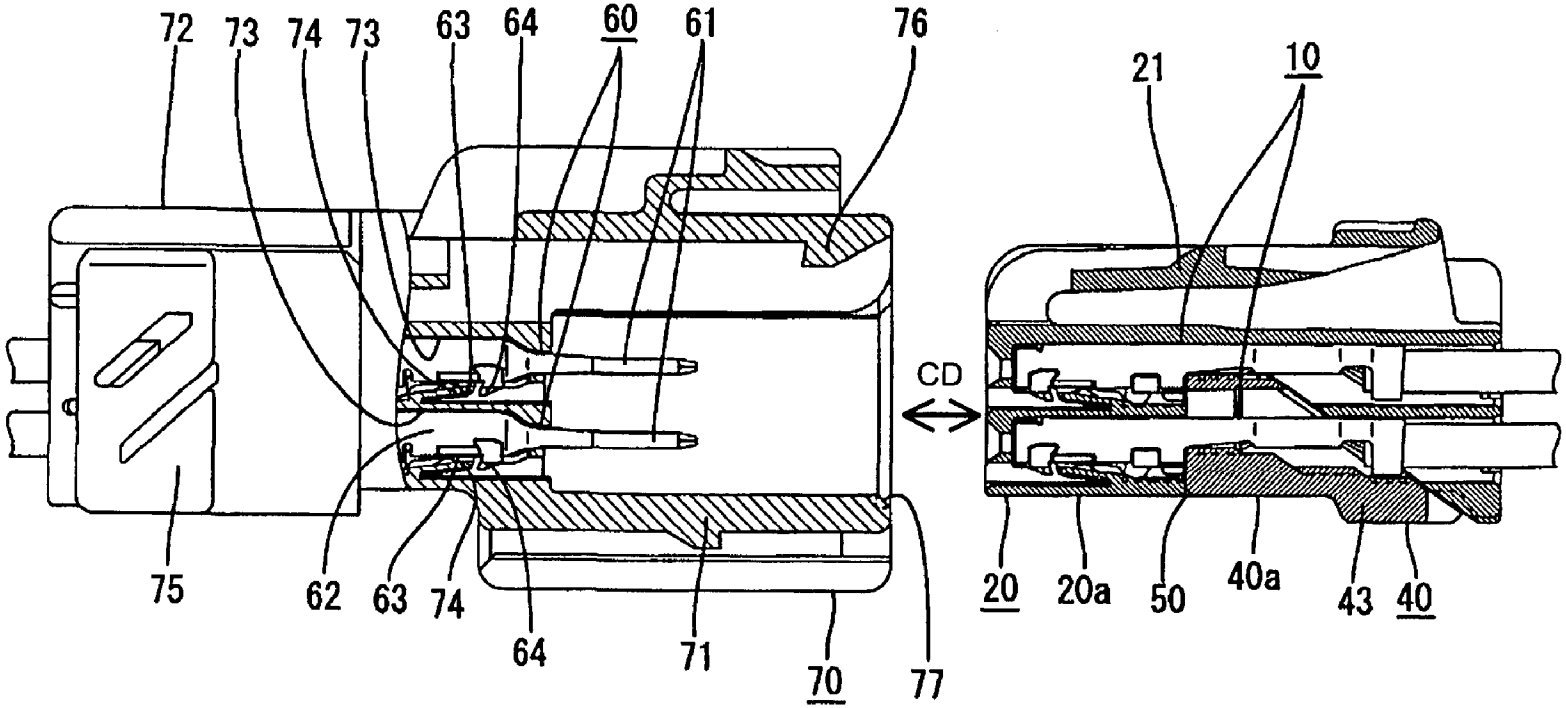
FIG. 15 is a side view in section showing the male housing and the female housing having the retainer mounted at the full locking position.

Each male terminal fitting 60 is formed by, e.g. bending, folding and/or embossing a conductive metallic plate stamped or cut out to have a specified development. Each male terminal fitting 60 has a tab 61 and a main portion 62 that are coupled one after the other. The tab 61 is insertable into the main portion 11 of the corresponding female terminal fitting 10 for electrical connection. The main portion 62 is substantially in the form of a box, as shown in FIG. 15. Similar to the female terminal fitting 10, a recess 63 and a locking projection 64 engageable with a lock are provided at the bottom surface of the main portion 62. Although not shown, the main portion 62 has a locking step and a protrusion engageable with a retainer 75 similar to the female terminal fitting 10. Additionally, a wire connection portion similar to the female terminal fitting 10 is coupled at the rear side of the main portion 62.

Figure 8:
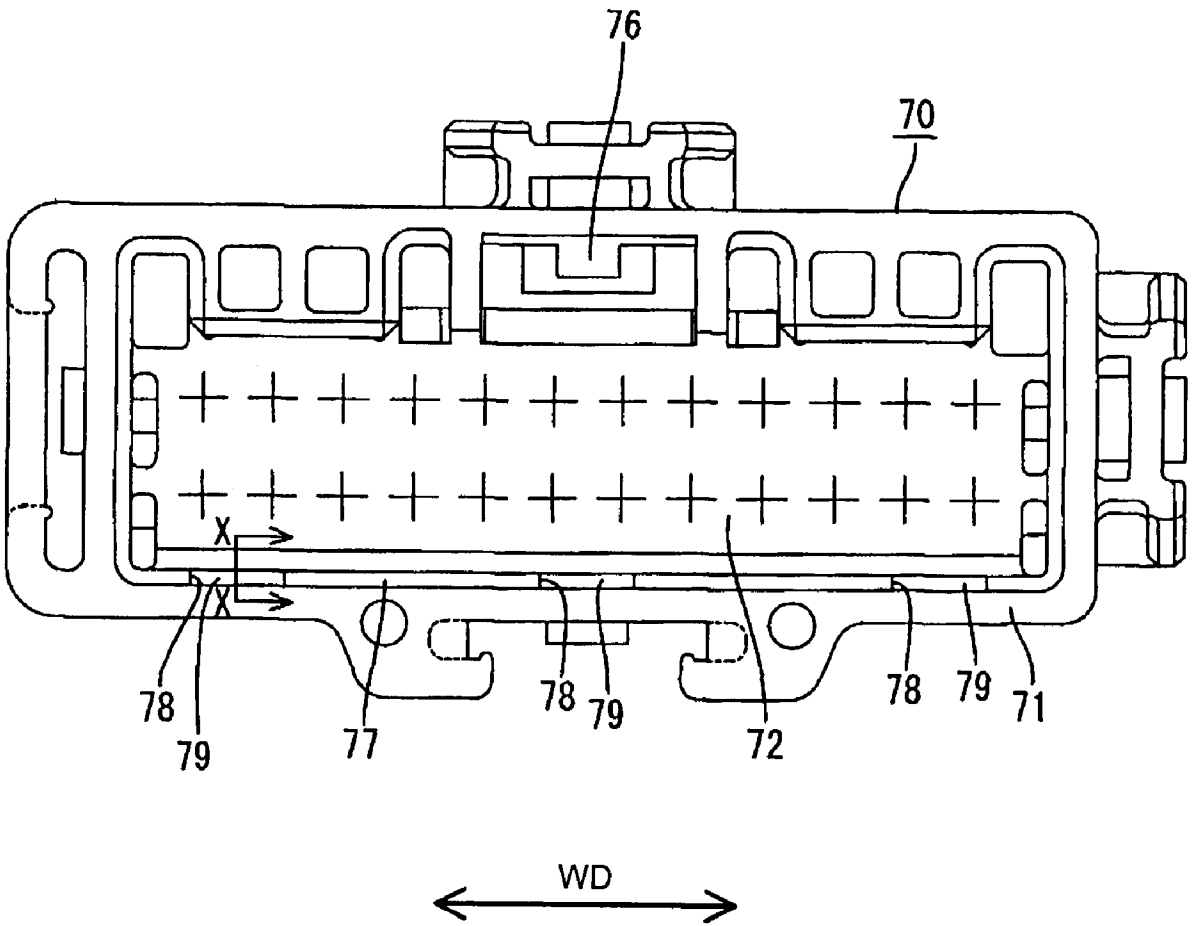
FIG. 8 is a front view schematically showing a male housing.

The male housing 70 is made e.g. of a synthetic resin and includes a receptacle 71 into which the female housing 20 is fittable from the front. A terminal accommodating portion 72 is disposed rearward of the receptacle 71 and accommodates the male terminal fittings 60, as shown in FIGS. 8 and 15. The terminal accommodating portion 72 is substantially a block that is wide along the widthwise direction WD. Cavities 73 are arranged at upper and lower stages in the terminal accommodating portion 72 and correspond to the cavities 22 of the female housing 20. The male terminal fittings 60 are insertable into the cavities 73 from behind. A resilient lock 74 at the bottom surface of each cavity 73 is engageable with the corresponding terminal fitting 60. Similar to the female housing 20, the retainer 75 for locking the male terminal fittings 60 is mountable into the terminal accommodating portion 72 from below and is movable obliquely between a partial locking position and a full locking position. The detailed construction of the retainer 75 is as described above.

The receptacle 71 is a wide rectangular tube that opens forward and substantially conforms to the female housing 20. The lock 76 projects down and out at a substantially widthwise middle of the ceiling surface of the receptacle 71 and is engageable with the lock arm 21 of the female housing 20 to hold the housings 20, 70 connected. An introducing surface 77 is formed over substantially the entire inner peripheral edge at the front end of the receptacle 71, except a part thereof, for introducing the female housing 20 and the retainer 40. The introducing surface 77 is slanted to gradually increase inner dimensions of the receptacle 71 towards the front side and is inclined at an acute angle to the connecting direction CD of the female housing 20. The introducing surface 77 is formed in a range of more than about one-fourth and/or less than about half, preferably about one-third of the thickness of the receptacle 71. The tabs 61 of the male terminal fittings 60 are surrounded at least partly by the receptacle 71.

Figure 9A:
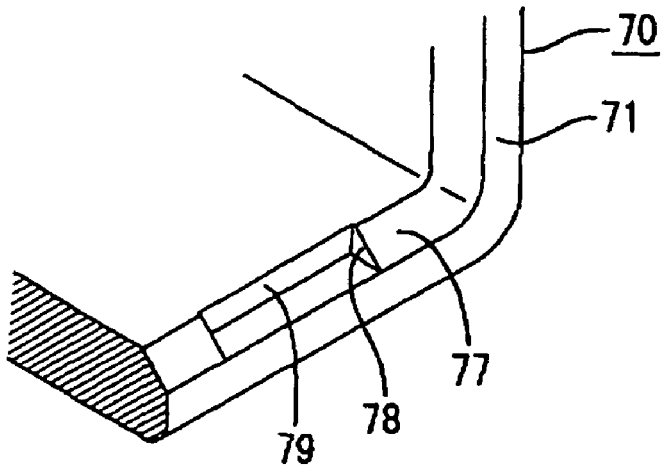
FIG. 9A is an enlarged perspective view showing an introducing surface, a recess and a receiving surface.

A lower part of the inner peripheral edge at the front end of the receptacle 71 has three recesses 78 that are retraced back from the introducing surface 77, as shown in FIGS. 8 and 9(A), for interfering with the interfering portion 49 of the retainer 40 of the female connector. The recesses 78 are at positions located slightly more inward than the opposite widthwise ends of the receptacle 71 and at a substantially widthwise middle position. Bottom surfaces of the recesses 78 are substantially horizontal along the widthwise direction and along the connecting direction CD. Additionally, the recesses 78 are at substantially the height of the front end of the introducing surface 77. The front surfaces of the recesses 78 overhang so that upper ends align with the rear end of the introducing surface 77 and so that bottom ends are slightly backward from the upper ends. Front receiving surfaces 79 of the recesses 78 incline slightly at an obtuse angle to the connecting direction CD of the female housing 20 and are retracted back from the introducing surface 77. The heights of the recesses 78 and the receiving surfaces 79 substantially equal the height of the introducing surface 77, and thus have depths more than about one-fourth and less than about half, preferably about one-third of the thickness of the receptacle 71. The recesses 78 and receiving surfaces 79 replace parts of the introducing surface 77 of the receptacle 71.

Figure 9B:
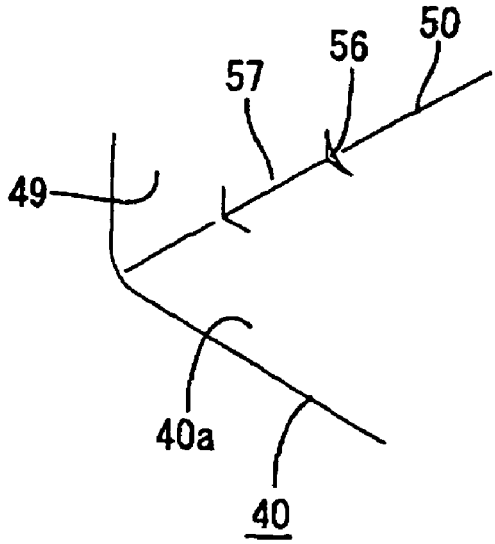
FIG. 9B is an enlarged perspective view showing a guiding surface, a bulging portion and a contact surface.

Three bulges 56 are provided on the front-bottom edge of the interfering portion 49 of the female retainer 40 formed with the guiding surface 50 and bulge more outward than the guiding surface 50, as shown in FIGS. 6 and 9(B). The bulges 56 are at positions that substantially face the respective recesses 78 when the housings 20, 70 are being connected The respective bulges 56 are rounded or slanted, and the front and lower surfaces thereof are substantially straight surfaces along the front surface and the bottom surface 40*a* of the retainer main body 41. Specifically, contact surfaces 57 are defined at the fronts of the bulges 56 and extend substantially straight, vertically and normal to the connecting direction CD. The contact surfaces 57 have upper ends substantially aligned with upper ends of the guiding surface 50 with respect to forward and backward directions, but they remain at substantially the same position with respect to forward and backward directions while the guiding surface 50 is sloped out and down toward the back. Accordingly, the contact surfaces 57 are more forward than the guiding surface 50. The bulges 56 and the contact surfaces 57 effectively replace parts of the guiding surface 50 of the interfering portion 49.

The bulges 56 of the interfering portion 49 enter the corresponding recesses 78 if an attempt is made to connect the two housings 20, 70 with the retainer 40 left at an incomplete mount position IMP before reaching the full locking position with respect to the female housing 20. Thus, the contact surfaces 57 contact the corresponding receiving surfaces 79. The receiving surfaces 79 are inclined only at a small angle to the vertical direction (an angle between about 80° to about 100° with respect to the connecting direction CD), as described above. Thus, the contact surfaces 57 come substantially into surface contact with the receiving surfaces 79. Further, the recesses 78 and the receiving surfaces 79 are wider than the bulges 56 and the contact surfaces 57. Thus, the bulges 56 securely enter the recesses 78, and the contact surfaces 57 securely contact the receiving surfaces 79 even if the bulges 56 are slightly displaced from the recesses 78 with respect to widthwise direction.

Figure 12:
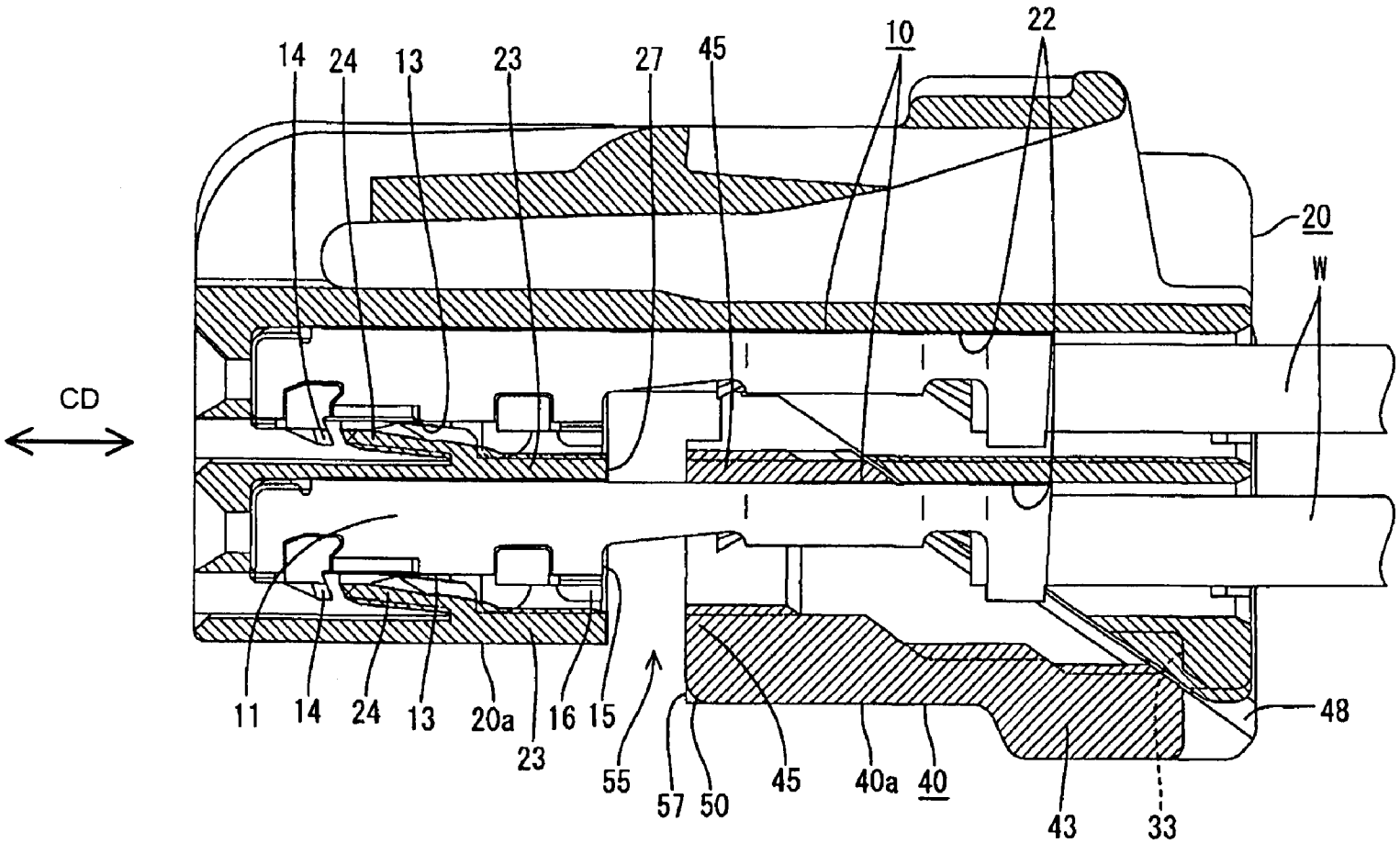
FIG. 12 is a side view in section showing a state where the female terminal fittings are inserted.

The female terminal fitting 10 is inserted into the cavity 22 with the retainer 40 at the partial locking position with respect to the female housing 20, as shown in FIG. 10. Thus, the locking projection 14 and the protrusion 16 are inserted into the protrusion insertion groove 25 and the stabilizer 17 is successively inserted into the stabilizer insertion groove 26 and the stabilizer passing groove 46. As a result, the female terminal fitting 10 is guided smoothly. The lock 24 is pressed by the locking projection 14 and temporarily deforms down and out when the female terminal fitting 10 is inserted to a specified depth. The locking projection 14 moves beyond the lock 24 when the female terminal fitting 10 reaches a proper depth. Thus, the lock 24 is restored resiliently to enter the recess 13 and engage the front edge of the recess 13 and the rear end surface of the locking projection 14, as shown in FIG. 12.

The retainer 40 is moved in the moving direction PD from the partial locking position (see FIG. 11) to the full locking position (see FIG. 14) after all of the female terminal fittings 10 have been inserted. The retainer 40 is pushed up and forward in the pushing direction PD, which is oblique to the inserting direction and the connecting direction CD. Thus, portions of the side plates 42 near the bottom ends of the guide grooves 51 deform to move onto the push-in preventing projections 31, which then exit the guide grooves 51. In this moving process, the retainer 40 is guided smoothly in the pushing direction PD by the engagement of the locking projections 29 and the guide grooves 51. The fastening sections 45 are at depths in the respective cavities 22 to engage the locking steps 15 and the rear end surfaces of the protrusions 16 of the female terminal fittings 10 when the retainer 40 reaches the full locking position shown in FIG. 13. As a result, the female terminal fittings 10 are locked doubly. The bottom surfaces 20*a*, 40*a* of the female housing 20 and the retainer 40 are substantially flush and the interfering portion 49 (including the bulges 56) is accommodated completely in the retainer mount hole 27 when the retainer 40 is at the full locking position.

At this full locking position, the locking projections 29 engage the bottom ends of the guide grooves 51 and the push-in preventing projections 30 engage the rear edges of the side plates 42, as shown in FIG. 14. In addition, the locking claws 54 move over the slanted surfaces 32*a* of the catching pieces 32 and engage the upper edges of the catching pieces 32, and the locks 48 enter the corresponding lock recesses 33 to have the rear surfaces thereof engage the front surfaces of the lock recesses 33. Thus, the retainer 40 is held firmly at the full locking position. Furthermore, the bottom edges of the shake preventing portions 31 engage the bottom edges of the preventing recesses 53 to prevent the retainer 40 from making upward shaking movements. The front edge of the retainer main body 41 substantially abuts the front edge of the retainer mount hole 27 to substantially close the clearance therebetween at the full locking position. Thus, dust or debris cannot enter the cavities 22.

Figure 16:
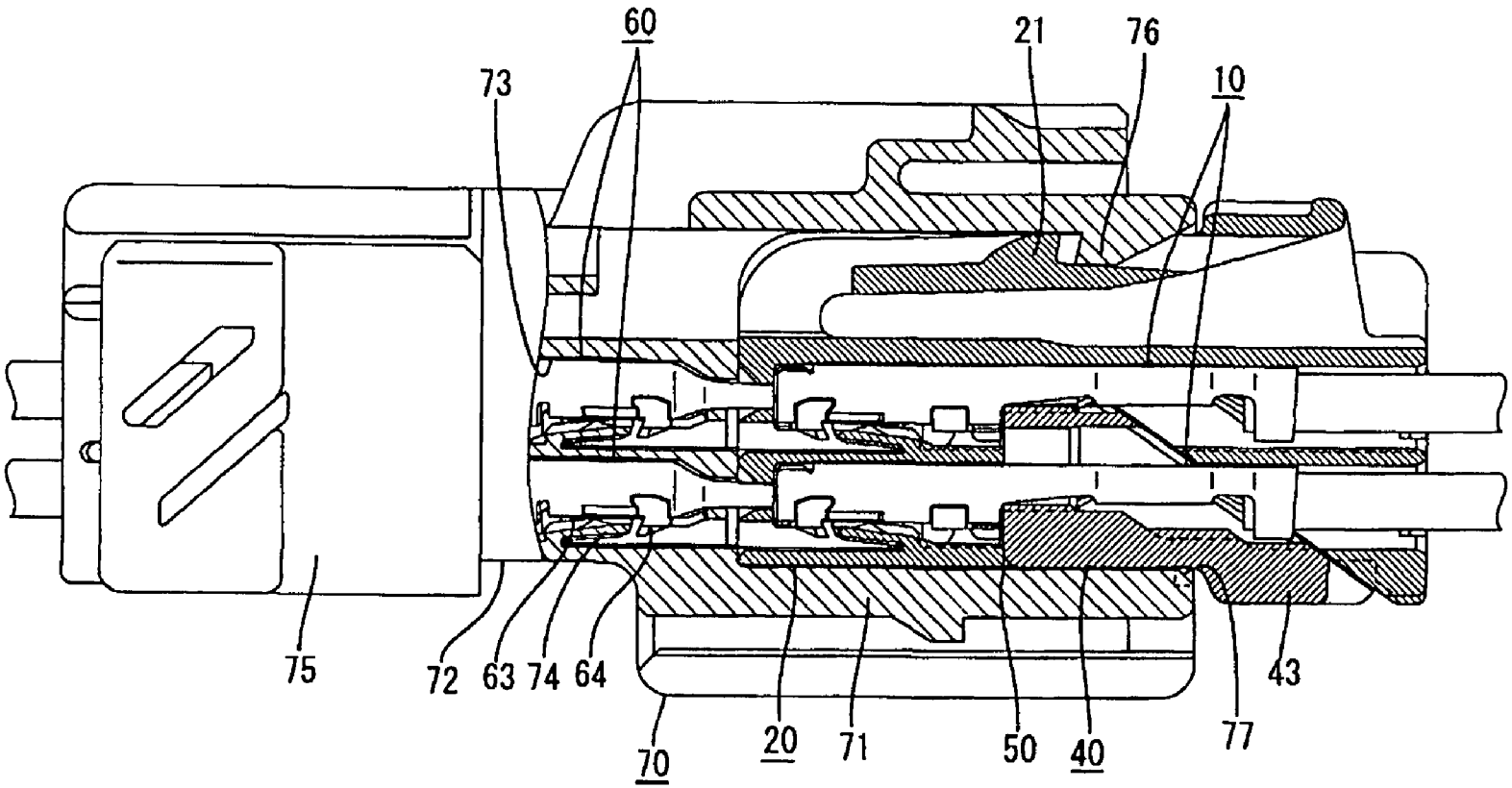
FIG. 16 is a side view in section showing a state where the two housings are connected.

The male connector is assembled substantially in the same or similar manner as the female connector. Thereafter, the two housings 20, 70 are connected along the connecting direction CD. As shown in FIG. 15, the female housing 20 faces the male housing 70 from the front and is fit into the receptacle 71. In this fitting process, the front peripheral edge of the female housing 20 is introduced into the receptacle 71 by the introducing surface 77. The introducing surface 77 and the guiding surface 50 of the retainer 40 guide the interfering portion 49 into the receptacle 71 when about the half of the female housing 20 is fitted, thereby smoothly performing the fitting operation. The lock arm 21 is pushed down and out by the lock 76 and resiliently deforms when the two housings 20, 70 are connected to a specified depth. Thereafter, the lock arm 21 is restored resiliently to engage the lock 76 when the housings 20, 70 are connected to a proper depth, as shown in FIG. 16, thereby properly electrically connecting the terminal fittings 10, 60. In this way, the two housings 20, 70 are held in their connected state.

Figure 17:
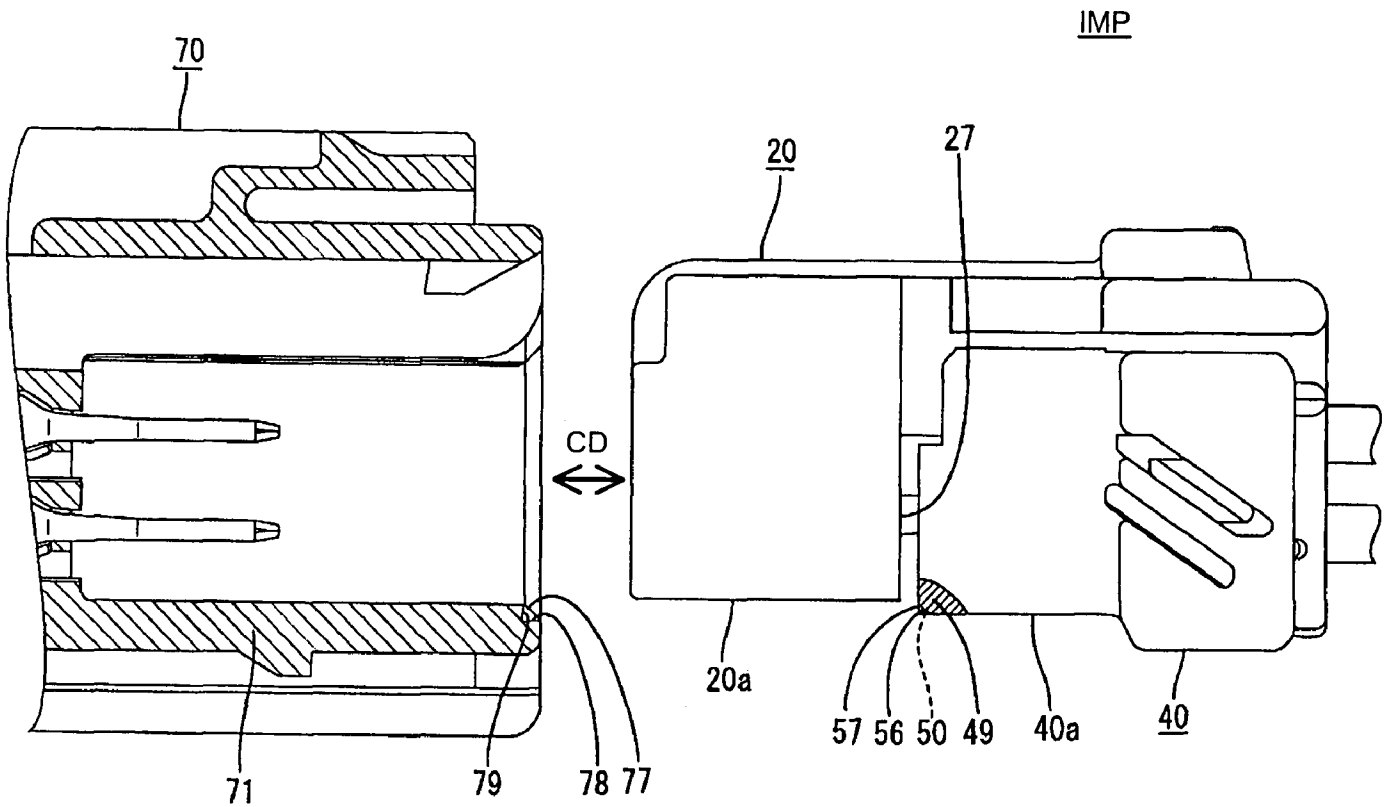
FIG. 17 is a side view with a partial section along line 17—17 of FIGS. 6 and 8 showing the male housing and the female housing having the retainer mounted at an incomplete mount position.
Figure 18:
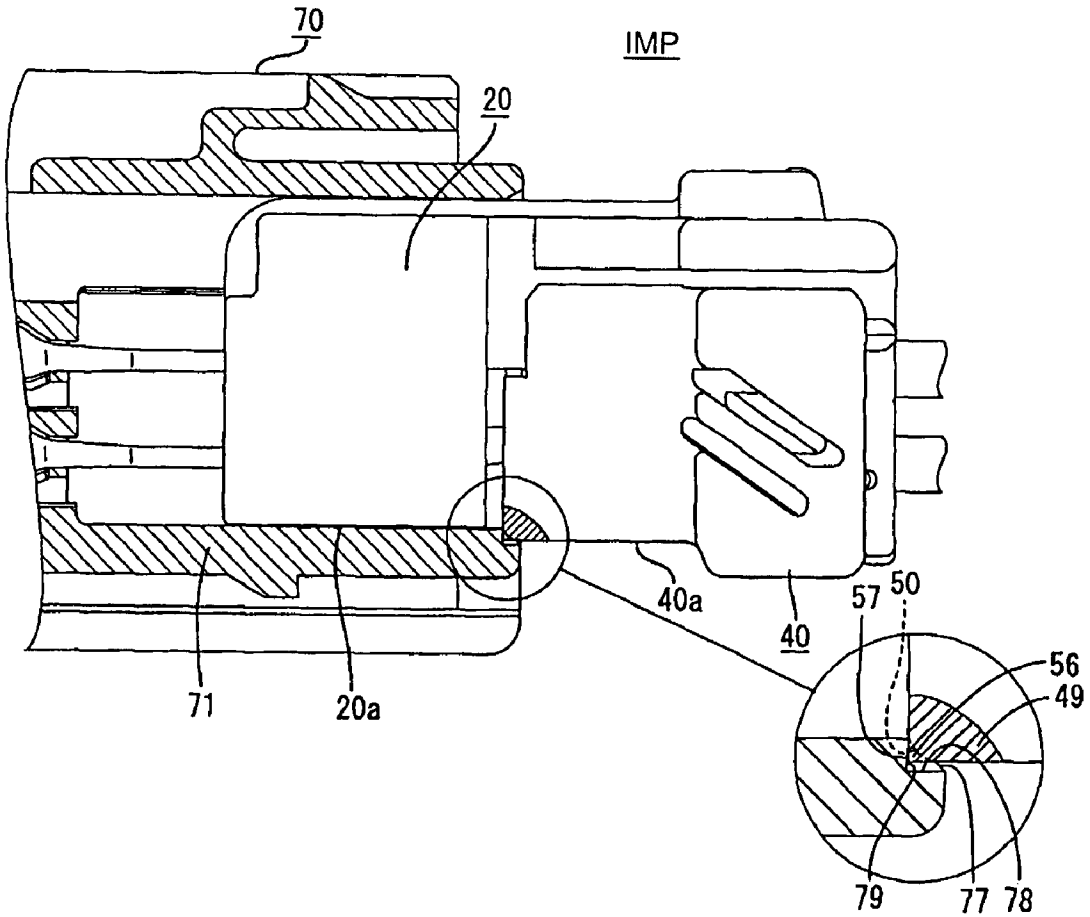
FIG. 18 is a side view partly in section that is similar to FIG. 17, but shows a state where the connection of the two housings is prevented.

In the process of assembling the female connector, the retainer 40 may be at an incomplete mount position IMP before reaching the full locking position as shown in FIG. 17 due to an insufficient force to push the retainer 40 to the full locking position. At such an incomplete mount position IMP, the fastening sections 45 may not enter the cavities 22 sufficiently to engage the locking steps 15 and the protrusions 16 of the female terminal fittings 10, and hence the locking forces may be insufficient. In such a case, the interfering portion 49 projects down from the bottom surface 20*a* of the female housing 20 by as much as a lacking amount of the pushing of the retainer 40. When the two housings 20, 70 are connected in this state of incomplete mounting IMP, the respective bulges 56 of the interfering portion 49 enter the corresponding recesses 78 when about half of the female housing 20 is fit into the receptacle 71. The connecting operation of the two housings 20, 70 is restricted by the contact of the contact surfaces 57 with the corresponding receiving surfaces 79 as shown in FIG. 18. At this time, a large resistance force is created since the respective contact surfaces 57 are in surface contact with the receiving surfaces 79 and are overhanging. Thus, the connecting operation is stopped securely. In this way, the incomplete mount position IMP of the retainer 40 is detected. The guiding surface 50 contacts the introducing surface 77 when the contact surfaces 57 and the receiving surfaces 79 contact each other.

The retainer 40 may be pushed less sufficiently than in the above case and the interfering portion 49 may project down and out from the bottom surface 20*a* of the female housing 20 by a longer distance than the height of the recesses 78 (introducing surface 77). Alternatively, an operation of pushing the retainer 40 to the full locking position may be forgotten. In either of these cases, the front surface of the retainer 40 surface contacts the front end surface of the receptacle 71 before the bulges 56 enter the corresponding recesses 78. Therefore, the connecting operation is prevented securely.

The contacting surfaces of the housings 20, 70 may be inclined with respect to the widthwise direction WD while connecting the housings 20, 70 with the retainer 40 at an incomplete mount position IMP. In such a case, the bulges 56 and the contact surfaces 57 may be displaced from the corresponding recesses 78 and the corresponding receiving surfaces 79 with respect to the widthwise direction WD. However, displacements of the bulges 56 and the contact surfaces 57 are taken up since the recesses 78 and the receiving surfaces 79 are wider than the bulges 56 and the contact surfaces 57. Accordingly, the bulges 56 still enter the corresponding recesses 78 to bring the contact surfaces 57 into contact with the receiving surfaces 79, and the incomplete mounting IMP of the retainer 40 is detected securely.

As described above, the bulges 56 and the contact surfaces 57 are provided in place of parts of the guiding surface 50 at the interfering portion 49 of the retainer 40, and the recesses 78 and the receiving surfaces 79 are provided in place of parts of the introducing surface 77 at the inner peripheral surface of the front of the receptacle 71. Thus, the bulges 56 enter the recesses 78 and the contact surfaces 57 come into surface contact with the receiving surfaces 79 if an attempt is made to connect the housings 20, 70 with the retainer 40 incompletely mounted (improper posture IMP). Therefore, a larger resistance force is created as compared to a case where the guide surface contacts the introducing surface as in the prior art. In this way, the connecting operation of the two housings 20, 70 is prevented securely, and the retainer 40 is determined to be at the incomplete mount position IMP.

Further, the receiving surfaces 79 are more backward than the introducing surface 77. Thus, a good connecting operability can be ensured without impairing a function of guiding the female housing 20 and the retainer 40 by the introducing surface 77 in the case that the retainer 40 is mounted at the full locking position with respect to the female housing 20.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The receiving surfaces are undercut in the foregoing embodiment. However, they may be straight along the vertical direction or slightly slanted. Likewise, the contact surfaces can be overhanging, undercut or slanted.

The upper ends of the receiving surfaces and the introducing surface substantially align along forward and backward directions in the foregoing embodiment. However, it is not always necessary to align them and the upper ends of the receiving surfaces may be shifted backward or forward from the upper end of the introducing surface according to the present invention. Likewise, the upper ends of the contact surfaces and the guiding surface can be shifted along forward and backward directions.

The recesses and the bulges can have substantially the same width. The number of the recesses and the bulges can also be set to any number other than three and the positions thereof can be arbitrarily set.

Although the introducing surface is slanted or chamfered in the foregoing embodiment, it may be curved, for example, to have an arcuate cross section. Likewise, the guiding surface may be a straight slanted surface.

The retainer is moved in the moving direction PD oblique to the inserting and withdrawing directions ID of the female/male terminal fittings in the foregoing embodiment. However, the invention is also applicable to cases where the retainer is moved substantially normal to the inserting and withdrawing directions ID of the female/male terminal fittings.

Connectors having the cavities at upper and lower stages are shown in the foregoing embodiment. However, the invention is also applicable to connectors having one, three or more stages of cavities. In a connector having one stage of cavities, terminal fittings may be inserted into the cavities before a retainer is mounted on a housing and, thereafter, the retainer may be mounted to a proper mount position with respect to the housing to lock the terminal fittings. In short, the partial locking position of the retainer may be omitted.

What is claimed is:

1. A connector, comprising:

a housing to be fit into a receptacle of a mating housing along a mating direction, and a retainer mountable to the housing along a mounting direction aligned to intersect the mating direction, the retainer being configured for locking at least one terminal fitting in the housing, wherein:

the retainer comprises at least one fastening section for locking the respective terminal fittings when the retainer is at a complete mount position with respect to the housing, and at least one interfering portion that can interfere with the receptacle when the retainer is stopped at an incomplete mount position before reaching the complete mount position, the interfering portion being formed with at least one guiding surface aligned direction for guiding the entrance of the interfering portion into the receptacle when the retainer is at the complete mount position, and the interfering portion is formed with at least one contact surface offset from the guiding surface in a direction transverse to the mating direction, the contact surface being aligned for achieving substantially surface contact with at least one receiving surface at a position on an inner peripheral edge of a leading end of the receptacle substantially corresponding to the contact surface.

2. The connector of claim 1, wherein at least one push-in preventing projection is provided on the housing for engaging the retainer, thereby preventing the retainer from being inadvertently pushed to the complete mount position unless an operation force of a specified intensity or higher is exerted.

3. The connector of claim 1, wherein when the retainer is at the incomplete mount position, at least one clearance is defined between the retainer and a retainer mount hole into which the retainer is at least partly insertable, so that the inserted states of the female terminal fittings can be confirmed through the clearance from the outside of the connector housing.

4. The connector of claim 1, wherein the housing comprises a retainer mount hole into which the retainer is insertable, wherein the retainer mount hole being open towards one side wall and two adjacent side walls of the housing.

5. The connector of claim 1, wherein the retainer comprises a main body and a pair of side plates bulging out at the substantially opposite widthwise ends of the main body.

6. The connector of claim 1, wherein the contact surface of the retainer is aligned substantially perpendicular to the mating direction of the housing and the mating housing.

7. The connector of claim 5, wherein when the retainer is at the complete mount position, the side plates are substantially flush with outer side surfaces of the housing.

8. A connector assembly, comprising:

a first housing including a receptacle and a first terminal fitting;

a second housing having a second terminal fitting and being fittable into the receptacle along a mating direction for connecting the first and second terminal fittings; and a retainer mountable on the second housing along a mounting direction aligned to intersect the mating direction, the retainer being configured for locking the second terminal fitting in the second housing, wherein:

the retainer comprises at least one fastening section for locking the respective terminal fitting when the retainer is mounted at a complete mount position with respect to the second housing, and at least one interfering portion for interfering with the receptacle when the retainer is stopped at an incomplete mount position before reaching the complete mount position, the interfering portion having at least one guiding surface aligned for guiding the interfering portion into the receptacle when the retainer is at the complete mount position, an introducing surface is formed at least partly around an inner peripheral edge of a leading end of the receptacle for introducing the second housing into the receptacle, and the interfering portion is formed with at least one contact surface offset from the guiding surface in a direction transverse to the mating direction, and at least one receiving surface at a position of the inner peripheral edge of the leading end of the receptacle substantially corresponding to the contact surface, the receiving surface being offset from the introducing surface and being disposed and aligned for achieving substantially surface contact with the contact surface when the retainer has not reached the complete mount position.

9. The connector assembly of claim 8, wherein the receiving surface is at a position more backward than the introducing surface.

10. The connector of claim 8, wherein the contact surface of the retainer is aligned substantially perpendicular to the mating direction of the housing and the mating housing.

11. The connector assembly of claim 9, wherein the receiving surface is wider than the contact surface.

12. The connector assembly of claim 11, wherein the receiving surface is inclined at an obtuse angle to the connecting direction of the housings.

13. The connector of claim 6, wherein the guiding surface of the retainer is aligned substantially at an acute angle to the mating direction of the housing with the mating housing.

14. The connector of claim 13, wherein a mounting direction of the retainer is aligned substantially at an acute angle to the mating direction of the housing with the mating housing.

15. The connector of claim 10, wherein the guiding surface of the retainer is aligned substantially at an acute angle to the mating direction of the housing with the mating housing.

16. The connector of claim 15, wherein a mounting direction of the retainer is aligned substantially at an acute angle to the mating direction of the housing with the mating housing.

* * * * *